US005711897A

United States Patent [19]

Havelka et al.

[11] Patent Number: 5,711,897

[45] Date of Patent: Jan. 27, 1998

[54] ELECTRORHEOLOGICAL FLUIDS OF POLAR SOLIDS AND ORGANIC SEMICONDUCTORS

[75] Inventors: Kathleen O. Havelka, Mentor; Joseph W. Pialet, Euclid, both of Ohio

[73] Assignee: The Lubrizol Corporation, Wickliffe, Ohio

[21] Appl. No.: 615,368

[22] Filed: Mar. 14, 1996

Related U.S. Application Data

[63] Continuation of Ser. No. 293,527, Aug. 19, 1994, abandoned.

[51] Int. Cl.[6] ..... C10M 171/00; C10M 169/04

[52] U.S. Cl. ..... 252/77; 252/73; 252/572

[58] Field of Search ..... 252/73, 74, 75, 252/77, 572

[56] References Cited

U.S. PATENT DOCUMENTS

| | | | |
|---|---|---|---|
| 3,992,558 | 11/1976 | Smith-Johannsen | 427/213 |
| 4,668,417 | 5/1987 | Goossens et al. | 252/75 |
| 4,687,589 | 8/1987 | Black et al. | 252/73 |
| 4,992,192 | 2/1991 | Ahmed | 252/73 |
| 5,073,282 | 12/1991 | Ahmed | 252/77 |
| 5,075,021 | 12/1991 | Carleon et al. | 252/73 |
| 5,213,895 | 5/1993 | Hirai et al. | 428/403 |
| 5,252,249 | 10/1993 | Kurachi et al. | 252/71 |
| 5,286,413 | 2/1994 | Hannecart et al.. | 252/500 |
| 5,435,932 | 7/1995 | Bryant et al. | 252/77 |
| 5,437,806 | 8/1995 | Bryant et al. | 252/77 |
| 5,503,763 | 4/1996 | Podszun et al. | 252/73 |

FOREIGN PATENT DOCUMENTS

| | | |
|---|---|---|
| 394049 | 10/1990 | European Pat. Off. . |
| 0394049 | 10/1990 | European Pat. Off. . |
| 6394649 | 10/1990 | European Pat. Off. . |
| 427520 | 5/1991 | European Pat. Off. . |
| 634473 | 1/1995 | European Pat. Off. . |
| 63-97694 | 4/1988 | Japan . |
| 646093 | 1/1989 | Japan . |
| 335095 | 2/1991 | Japan . |
| 3-119098 | 5/1991 | Japan . |
| 3119098 | 5/1991 | Japan . |
| 3160094 | 7/1991 | Japan . |
| 3-192195 | 8/1991 | Japan . |
| 5239482 | 2/1992 | Japan . |
| 5-239482 | 9/1993 | Japan . |
| 9000583 | 1/1990 | WIPO . |
| WO90/61583 | 8/1990 | WIPO . |
| 9307243 | 4/1993 | WIPO . |
| 9307244 | 4/1993 | WIPO . |

OTHER PUBLICATIONS

Synthetic Metals, 64 (1994) pp. 27–31, R.W. Gumbs, "Synthesis of Electrically Conductive Vinyl Copolymers" No Month Available.

"Electrorheological property of a polyaniline–coated silica suspension", pp. 169–171, Iketani Science and Technology Foundations (1994).

European Publication 311,984, Apr. 19, 1989 [Brooks, American Cyanamide].

German Publication 41 31 142, Mar. 25, 1993, Podszun et al. [Bayer].

European Publication 201,827, Nov. 20, 1986,.

Japanese patent publication 4 296 394, Oct. 20, 1992, Patent Abstracts of Japan [Fujimoto; Toyota].

*Primary Examiner*—Christine Skane

*Attorney, Agent, or Firm*—David M. Shold; Frederick D. Hunter

[57] ABSTRACT

An electrorheological fluid of a particulate phase and a continuous phase of a hydrophobic liquid medium, a certain dispersed particulate phase, and a low molecular weight polar material exhibits a broad effective temperature range. The dispersed particulate phase comprises a polar solid material which is capable of exhibiting substantial electrorheological activity only in the presence of a low molecular weight polar material, and an organic semiconductor. The weight ratio of the polar solid material to the organic semiconductor is at least about 2:1.

26 Claims, No Drawings

ELECTRORHEOLOGICAL FLUIDS OF POLAR SOLIDS AND ORGANIC SEMICONDUCTORS

This is a continuation of application Ser. No. 08/293,527, filed Aug. 19, 1994, now abandoned.

BACKGROUND OF THE INVENTION

The present invention relates to particles suitable for use in electrorheological fluids and electrorheological fluids containing such particles.

Electrorheological ("ER") fluids are fluids which can rapidly and reversibly vary their apparent viscosity in the presence of an applied electric field. ER fluids are generally dispersions of finely divided solids in hydrophobic, electrically non-conducting oils. They have the ability to change their flow characteristics, even to the point of becoming solid, when subjected to a sufficiently strong electrical field. When the field is removed, the fluids revert to their normal liquid state. ER fluids can be used in applications in which it is desired to control the transmission of forces by low electric power levels, for example, in clutches, hydraulic valves, shock absorbers, vibrators, or systems used for positioning and holding work pieces in position.

The prior art teaches the use of a variety of fine particles, some with surface coatings of various types. For example, PCT Publication WO93/07244, published Apr. 15, 1993, discloses electrorheological fluid comprising polyaniline. The polymer can be formed in the presence of solid substrates such as silica, mica, talc, glass, alumina, zeolites, cellulose, organic polymers, etc. In these embodiments, the polymerized aniline generally is deposited on the substrate as a coating which may also penetrate into the open pores in the substrate.

Japanese Publication 5 239,482, Feb. 28, 1992,discloses inorganic or organic particles, coated with a polyaniline, and the polyaniline-coated particles dispersed as a dispersed phase. The effect is that an electro-viscous fluid having large electro-viscous effects is obtained.

One of the goals in development of a practical electrorheological fluid is to develop materials which have continually improved combinations of high electrorheological activity and low conductivity, and to retain this desirable combination throughout increasingly broad temperature ranges. The materials of the present invention exhibit such a useful combination of properties.

SUMMARY OF THE INVENTION

The present invention provides an electrorheological fluid of a particulate phase and a continuous phase, comprising:

(a) a hydrophobic liquid medium, (b) a dispersed particulate phase comprising (i) a polar solid material which is capable of exhibiting substantial electrorheological activity only in the presence of a low molecular weight polar material, and (ii) an organic semiconductor, wherein the weight ratio of the polar solid material to the organic semiconductor is at least about 2:1; and (c) a low molecular weight polar material.

The present invention further provides a method for increasing the apparent viscosity of such a fluid, comprising applying an electric field to said fluid.

The invention also provides a clutch, valve, shock absorber, damper, or torque transfer device containing the fluid set forth above.

DETAILED DESCRIPTION OF THE INVENTION

The first component of the present electrorheological fluids is a hydrophobic liquid phase, which is a non-conducting, electrically insulating liquid or liquid mixture. Examples of insulating liquids include silicone oils, transformer oils, mineral oils, vegetable oils, aromatic oils, paraffin hydrocarbons, naphthalene hydrocarbons, olefin hydrocarbons, chlorinated paraffins, synthetic esters, hydrogenated olefin oligomers, hydrocarbon oils generally, and mixtures thereof. The choice of the hydrophobic liquid phase will depend largely on practical considerations including compatibility of the liquid with other components of the system, solubility of certain components therein, and the intended utility of the ER fluid. For example, if the ER fluid is to be in contact with elastomeric materials, the hydrophobic liquid phase should not contain oils or solvents which affect those materials. Similarly, the liquid phase should be selected to have suitable stability over the intended temperature range, which in the case of the present invention will extend to 120° C. or even higher. Furthermore, the fluid should have a suitably low viscosity in the absence of a field that sufficiently large amounts of the dispersed phase can be incorporated into the fluid. Suitable liquids include those which have a viscosity at room temperature of 1 to 300 or 500 centistokes, or preferably 2 to 20 or 50 centistokes. Mixtures of two or more different non-conducting liquids can be used for the liquid phase. Mixtures can be selected to provide the desired density, viscosity, pour point, chemical and thermal stability, component solubility, etc.

Useful liquids generally have as many of the following properties as possible: (a) high boiling point and low freezing point; (b) low viscosity so that the ER fluid has a low no-field viscosity and so that greater proportions of the solid dispersed phase can be included in the fluid; (c) high electrical resistance and high dielectric breakdown potential, so that the fluid will draw little current and can be used over a wide range of applied electric field strengths; and (d) chemical and thermal stability, to prevent degradation on storage and service.

Alkylene oxide polymers and interpolymers and derivatives thereof where the terminal hydroxyl groups have been modified by esterification, etherification, etc., constitute a class of hydrophobic liquids. These are exemplified by polyoxyalkylene polymers prepared by polymerization of ethylene oxide or propylene oxide, the alkyl and aryl ethers of these polyoxyalkylene polymers (e.g., methyl-poly isopropylene glycol ether having an average molecular weight of 1000, diphenyl ether of poly-ethylene glycol having a molecular weight of 500–1000, diethyl ether of polypropylene glycol having a molecular weight of 1000–1500); and mono- and polycarboxylic esters thereof, for example, the acetic acid esters, mixed $C_3$–$C_8$ fatty acid esters and $C_{13}$ Oxo acid diester of tetraethylene glycol.

Another suitable class of hydrophobic liquids comprises esters of dicarboxylic acids (e.g., phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids) with a variety of alcohols and polyols (e.g., butyl alcohol, hexyl alcohol, dodecyl alcohol, 2-ethylhexyl alcohol, ethylene glycol, diethylene glycol, monoether, propylene glycol). Specific examples of these esters include dibutyl adipate, di(2-ethylhexyl) sebacate, dion-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid. By way of example, one of the suitable esters is di-isodecyl azelate, available under the name Emery™ 2960.

Esters useful as hydrophobic liquids also include those made from $C_5$ to $C_{18}$ monocarboxylic acids and alcohols, polyols, and polyol ethers such as isodecyl alcohol, neopentyl glycol, trimethylolpropane, pentaerythritol, dipentaerythritol and tripentaerythritol.

Polyalpha olefins and hydrogenated polyalpha olefins (referred to in the art as PAOs) are useful in the ER fluids of the invention. PAOs are derived from alpha olefins containing from 2 to 24 or more carbon atoms such as ethylene, propylene, 1-butene, isobutene, 1-decene, etc. Specific examples include polyisobutylene having a number average molecular weight of 650; a hydrogenated oligomer of 1-decene having a viscosity at 100° C. of 8 cSt; ethylenepropylene copolymers; etc. An example of a commercially available hydrogenated polyalpha olefin is Emery™ 3004.

Silicon-based oils such as the polyalkyl-, polyaryl-, polyalkoxy-, or polyaryloxysiloxane oils and silicate oils comprise a particularly useful class of hydrophobic liquids. These oils include tetraethyl silicate, tetraisopropyl silicate, tetra-(2-ethyihexyl) silicate, tetra-(4-methyl-2-ethylhexyl) silicate, tetra(p-terbutylphenyl) silicate, hexa-(4-methyl-2-pentoxy) disiloxane, poly(methyl) siloxanes, including poly (dimethyl)siloxanes, and poly(methylphenyl) siloxanes. The silicone oils are useful particularly in ER fluids which are to be in contact with elastomers.

Among the suitable vegetable oils for use as the hydrophobic liquid phase are sunflower oils, including high oleic sunflower oil available under the name Trisun™ 80, rapeseed oil, and soybean oil. Examples of other suitable materials for the hydrophobic liquid phase are set forth in detail in PCT publication WO93/14180, published Jul. 22, 1993. The selection of these or other fluids will be apparent to those skilled in the art.

The second component of the present electrorheological fluids is a dispersed particulate phase. This phase itself comprises two subcomponents. The first of these is a polar solid material which is capable of exhibiting substantial electrorheological activity only in the presence of a low molecular weight polar material. The preferred particles are polymeric materials. Materials, such as organic semiconductors, which are capable of exhibiting substantial activity even in the absence of any so-called activating agent or alternate polar material are not contemplated as constituting this subcomponent, although such materials might be envisioned as a relatively minor portion of this subcomponent, for instance, admixed with the principal material. However, the use of an intrinsically ER-active material such as polyaniline by itself as this subcomponent is not contemplated.

The expression "capable of exhibiting substantial electrorheological activity," as used herein, means that a fluid containing the particles, compounded and tested under standard conditions, exhibits substantial electrorheological activity. A standard formulation and test for ER activity is described in PCT publication WO93/22409, published Nov. 11, 1993. The material to be tested is supplied as a powder, preferably having a particle size such that it will pass through a 710 μm mesh screen. The particles are thoroughly dried, for instance by heating for several hours in a vacuum oven at 150° C. The dried particles are compounded into a fluid for electrorheological testing by combining on a ball mill 25 g of the particles with 96.25 g of a 10 cSt silicone base fluid and 3.75 g of a functionalized silicone dispersant (EXP 69™) for 24 hours. Water or other low molecular weight polar material is or is not added. The fluid can be tested in an oscillating duct flow device. This device pumps the fluid back and forth through parallel plate electrodes, with a mechanical amplitude of flow of ±1 mm and an electrode gap of 1 mm. A useful mechanical frequency for evaluation is 16–17 Hz. (These conditions provide a maximum shear during the cycle of approximately 20,000 $sec^{-1}$) The electrorheological activity can be evaluated by comparing the properties of the fluid at 20° C. under a 6 kV/mm field with the properties in the absence of applied field. It is to be understood that the field strength, concentrations of materials, or mechanical design of the test device can be modified as necessary to suit the particular fluid, as will be apparent to the person skilled in the art. The presence of substantial electrorheological activity can be concluded when the shear stress in the presence of the field is increased by at least 20% compared with that in the absence of field. The absence of substantial electrorheological activity would be concluded if the shear stress increases by less than 20%.

One preferred class of ER active solids suitable for use as this portion of the dispersed phase includes carbohydrate based particles and related materials such as starch, flour, monosaccharides, and preferably cellulosic materials. The term "cellulosic materials" includes cellulose as well as derivatives of cellulose such as microcrystalline cellulose. Microcrystalline cellulose is the insoluble residue obtained from the chemical decomposition of natural or regenerated cellulose. Crystallite zones appear in regenerated, mercerized, and alkalized celluloses, differing from those found in native cellulose. By applying a controlled chemical pretreatment to destroy molecular bonds holding these crystallites, followed by mechanical treatment to disperse the crystallites in aqueous phase, smooth colloidal microcrystalline cellulose gels with commercially important functional and rheological properties can be produced. Microcrystalline cellulose can be obtained from FMC Corp. under the name Lattice™ NT-013. Amorphous cellulose is also useful in the present invention; examples of amorphous cellulose particles are CF1, CF11, and CC31, derived from cotton and available from Whatman Specialty Products Division of Whatman Paper Limited; and Solka-Floc™, derived from wood pulp and available from James River Corp. Other cellulose derivatives include ethers and esters of cellulose, including methyl-cellulose, ethyl cellulose, hydroxyethyl cellulose, hydroxypropyl cellulose, cellulose nitrates, sodium carboxymethyl cellulose, cellulose propionate, cellulose butyrate, cellulose valerate, and cellulose triacetate. Other cellulose derivatives include cellulose phosphates and cellulose reacted with various amine compounds. Other cellulosic materials include chitin, chitosan, chondroiton sulfate, certain natural gums such as xanthan gum, and viscose or cellulose xanthate. Cellulosic materials, and in particular cellulose, are preferred materials for the present invention. A more detailed listing of suitable cellulosics is set forth in PCT publication WO93/14180.

Inorganic materials which can be suitably used as ER active particles include silica gel, magnesium silicate, alumina, silica-alumina, pyrogenic silica, zeolites, and the like.

Another class of suitable ER active solid particles is that of polymeric salts, including silicone-based ionomers (e.g. the ionomer from amine functionalized diorganopolysiloxane plus acid), metal thiocyanate complexes with polymers such as polyethylene oxide, and carbon based ionomeric polymers including salts of ethylene/acrylic or methacrylic acid copolymers or phenolformaldehyde polymers. One preferred polymer comprises an alkenyl substituted aromatic comonomer, a maleic acid comonomer or derivative thereof, and optionally additional comonomers, wherein the polymer contains acid functionality which is at least partly in the form of a salt. Preferably in such materials the maleic acid comonomer is a salt of maleic acid in which the maleic acid comonomer is treated with 0.5 to 2 equivalents of base. Preferably this material is a 1:1 molar alternating copolymer of styrene and maleic acid, the maleic acid being partially in the form of the sodium salt. This material is described in more detail in PCT publication WO93/22409, published Nov. 11, 1993.

Certain of the above-mentioned solid particles are customarily available in a form in which a certain amount of water or other low molecular weight polar material is present, which is discussed in greater detail below. This is particularly true for polar organic particles such as cellulose or ionic polymers. These liquid polar materials need not necessarily be removed from the particles, but they are not necessarily required for the functioning of the present invention.

The particles used as this portion of the ER fluids of the present invention can be in the form of powders, fibers, spheres, rods, core-shell structures, etc. The size of the particles of the present invention is not particularly critical, but generally particles having a number average size of 0.25 to 100 μm, and preferably 1 to 20 μm, are suitable. The maximum size of the particles would depend in part on the dimensions of the electrorheological device in which they are intended to be used, i.e., the largest particles should normally be no larger than the gap between the electrode elements in the ER device. Since the final particles of this invention consist of the primary particle plus a second, organic semiconductor material, which maybe present as a coating, the size of the first (core) particle should be correspondingly somewhat smaller than the desired size of the final particle in such cases.

The second subcomponent of the particle phase is an organic semiconductor. Organic semiconductors are organic materials which show at least a moderate amount of electrical conductivity. The specific limits for what constitutes a semiconductor have been variously defined to range from a conductivity of $10^3$ to $10^{-12}$ siemens/cm, more commonly $10^2$ to $10^{-9}$ or $10^{-7}$ S/cm, as defined in ASTM D-4496-85. The conductivity of the desired organic semiconductors is that which is generally considered to be an inherent feature of the material itself (including any dopants), that is, electronic conductivity, as opposed to conductivity by virtue of the presence of adsorbed or absorbed materials such as water or alternate polar materials, to be described in detail below, that is, ionic conductivity.

The organic semiconductor can be a monomeric charge transfer material comprising a combination of one or more electron donors with one or more electron acceptors. Suitable electron donors include tetrathiafulvalene (TTF), N-ethylcarbazole, tetrathiotetracene, tetramethyl-p-phenylenediamine, hexamethylbenzene, and tetramethyltetraselenofulvalene (TMTSeF). Suitable electron acceptors include tetracyanoquinodimethane (TCNQ), tetracyanobenzene, tetracyanoethylene, and p-chloranil. An illustrative charge transfer material is TTF-TCNQ.

Preferably the organic semiconductor is a polymeric material. Polymeric organic semiconductors include polyanilines and poly(substituted anilines), polypyrroles, polythiophenes, polyphenylenevinylenes, polyphenylenes, polyacetylenes, polyphenothiazines, polyimidazoles, mixtures of the above materials, and both homopolymers and copolymers of the above materials. Polypyrroles, including polymers of substituted pyrrole and copolymers of pyrrole and other copolymerizable monomers represent one class of conductive polymers useful in the present invention. The term "polypyrrole" means polymers containing polymerized pyrrole rings including substituted pyrrole rings such as those represented by the following formula

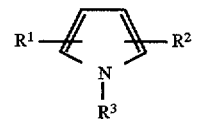

(I)

wherein $R^1$ $R^2$ and $R^3$ are each independently hydrogen or a lower alkyl group containing from 1 to 7 carbon atoms. Examples of lower alkyl groups include methyl, ethyl, n-propyl, i-propyl, etc. In one preferred embodiment, $R^1$, $R^2$ and $R^3$ are independently methyl groups. Examples of such pyrroles include N-methyl pyrrole and 3,4-dimethyl pyrrole. Copolymers of pyrrole and N-methyl pyrrole or 3,4-dimethyl pyrrole can be used in the present invention. Alternatively, pyrrole or substituted pyrroles of the type represented by Formula (I) can be copolymerized with other copolymerizable monomers, and in particular, other heterocyclic ring compounds including those containing nitrogen such as pyridine, aniline, indole, imidazole, etc., furan and thiophene, or with other aromatic or substituted aromatic compounds.

Polymers and copolymers of pyrrole are available commercially from a variety of sources or can be manufactured by techniques well known to those skilled in the art. For example, polymers of pyrrole can be obtained by electropolymerization as reported in U.K. Patent 2,184,738 and by Diaz et al, J. *Chem. Soc., Chem. Comm.*, 635 (1979) and in *J. Chem. Soc., Chem. Corem,*, 397 (1980). Polypyrrole is electrically conducting in the charged or oxidized state (black), and produced in this state by electropolymerization. If polypyrrole is completely reduced to the neutral or discharge state (yellow), it is an electronic insulator. Polypyrrole, and in particular, pyrrole black can be formed as a polymeric powdered material by oxidizing pyrrole in homogeneous solution (e.g., with hydrogen peroxide). Gardini in *Adv. Heterocyl. Chem.*, 15, 67 (1973) describes such a process and product. Pyrrole can also be oxidized into a polypyrrole with other oxidizing agents such as ferric chloride. Porous electronically conducting compositions comprising an electropolymerized polypyrrole or a copolymer of a pyrrole useful as the dispersed particulate phase in the ER fluids of the present invention are described in U.K. 2,184,738.

Polyphenylenes are also useful as the second subcomponent of the dispersed particulate phase in the ER fluids of the present invention. The term "polyphenylenes" as used herein and in the claims is intended to include polyphenylene, polyphenylene sulfide and polyphenylene oxide, in particular the poly-p-phenylenes.

The conductive polymers useful in the present invention also can comprise polyacetylenes. Polyacetylenes can be prepared by processes known to those skilled in the art, and polyacetylenes of various molecular weights can be utilized in the ER fluids of the present invention as the dispersed particulate phase.

Polymers of other heterocyclic nitrogen-containing compounds are also useful, and these include polyimidazoles and polyphenothiazines. Particularly useful are polymers of imidazole, 1-vinylimidazole, and phenothiazine.

The preferred materials for use as the second subcomponent of the dispersed particulate phase are polyanilines, including polyaniline homopolymer, polyaniline copolymers, polymers comprising at least one substituted aniline monomer, and other comonomers of aniline or substituted anilines.

The polyanilines can be prepared by polymerizing aniline in the presence of an oxidizing agent and preferably 0.1 to 2 moles, more preferably up to 1.6 moles and even more preferably about one mole of an acid per mole of aniline to form an acid salt of polyaniline. Thereafter the acid salt is treated with a base. The polyanilines useful as the dispersed particulate phase in the ER fluid of the present invention can also be obtained by polymerizing the mixtures of aniline and preferably up to 50% by weight of another monomer selected from pyrroles, vinyl pyridines, vinyl pyrrolidones, thiophenes, vinylidene halides, phenothiazines, imidazolines, N-phenyl-p-phenylene diamines or mixtures thereof. For example, the polyaniline can be prepared from a mixture of aniline and up to 50% by weight of pyrrole or a substituted pyrrole such as N-methylpyrrole and 3,4-dimethylpyrrole. Both random and block copolymers are contemplated. The synthesis of copolymers of vinyl compounds and aniline or related materials is described in R. W. Gumbs, "Synthesis of Electrically Conductive Vinyl Copolymers," *Synthetic Metals* 64 (1994) 27–31.

As noted, the polymerization is conducted in the presence of an oxidizing agent. Preferably the polymerization is accomplished in the presence of 0.8 to 2 moles of the oxidizing agent per mole of aniline. Various oxidizing agents can be utilized to effect the polymerization of the aniline, and useful oxidizing agents include peroxides such as sodium peroxide, hydrogen peroxide, benzoyl peroxide, and the like; alkali metal chlorates such as sodium chlorate and potassium chlorate; alkali metal perchlorates such as sodium perchlorate and potassium perchlorate; periodic acid; alkali metal iodates and periodates such as sodium iodate and sodium periodate; persulfates such as metal or ammonium persulfates; and chlorates. Alkali metal and alkaline earth metal persulfates can be utilized. The metal and ammonium persulfates, particularly alkali metal or ammonium persulfates are especially useful as the oxidizing agent.

Polymerization of the aniline, as noted above, is conducted in the presence of an acid. In a preferred embodiment, 0.1 to 1.6 or even 2 moles of an acid can be used per mole of aniline or mixture of aniline and any of the comonomers described above. In another embodiment, 0.8 to 1.2 moles of acid are utilized per mole of aniline, and in a more preferred embodiment, the aniline is polymerized in the presence of approximately equimolar amounts of oxidizing agent and acid.

The acid which is utilized in the polymerization reaction can be an organic acid or an inorganic acid with the inorganic acids generally preferred. Examples of inorganic acids which are useful include mineral acids such as hydrochloric acid, sulfuric acid and phosphoric acid.

Organic acids which can be used in the polymerization of aniline include, for example, sulfonic acids, sulfinic acids, carboxylic acids or phosphorus acids, and these acids can be alkyl or aryl-substituted acids. Partial salts of such acids also can be used. The organic acids can contain one or more of the sulfonic, sulfinic or carboxylic acid groups, and the acids may, in fact, be polymeric acids. Such acids are described more fully in PCT publication WO93/07244, published Apr. 15, 1993.

In one embodiment of the present invention, the polyaniline, in its acid salt form, is prepared by adding an aqueous solution of the oxidizing agent to an aqueous mixture of aniline and optionally any comonomers, and acid while maintaining the temperature of the reaction mixture below 50° C. In a preferred embodiment, the temperature of the reaction is maintained near or below room temperature. The polymerization reaction is generally completed in 3 to 10 hours, although the reaction mixture is generally stirred for periods of up to 24 hours at room temperature after the initial reaction period. The polyaniline acid salts obtained in this manner generally are washed with water or slurried in water and/or an alcohol such as methanol for periods of up to 24 or even 48 hours and thereafter dried.

The acid salts of polyaniline prepared in accordance with the above procedures generally are treated with a base to remove protons from the acid salt, and reduce the conductivity of the polyaniline salt. The protons include those derived from both the acid and the oxidant used in the polymerization reaction. Various basic materials may be utilized to deprotonate the acid salt. Generally, the base is ammonium hydroxide or a metal oxide, hydroxide, alkoxide or carbonate. The metal may be an alkali metal such as sodium or potassium or an alkaline earth metal such as barium, calcium or magnesium. When the base is ammonium hydroxide or alkali metal hydroxide or carbonate, aqueous solutions of the hydroxide and carbonate are utilized for reaction with the acid salt of polyaniline. When metal alkoxides are utilized for this purpose, the solvent or diluent is generally an alcohol. Examples of alkoxides which may be utilized include sodium methoxide, potassium ethoxide, sodium ethoxide, sodium propoxide, etc. Examples of alcohol include methanol, ethanol, propanol, etc.

The extent of washing and the details of the washing process will depend to some extent on the desired properties of the final electrorheological fluid and the form in which the solid components of the fluid are combined. If the polyaniline is employed as a separate particulate phase, along with the polar solid material (i), it can be prepared and washed substantially as described in PCT publication WO93/07244. In one such embodiment, the polyaniline acid salts prepared in accordance with the process of the present invention are treated with an amount of the base for a period of time which is sufficient to remove substantially all of the protons derived from the acid. For example, if the acid utilized in the polymerization is hydrochloric acid, the polyaniline acid salt is treated with the base in an amount which is sufficient to reduce the chloride content of the acid salt to as low as from 0 to 0.2%. If the polyaniline is applied as a coating on particles of the polar solid material (i), the details of the washing process will be adjusted in a manner which will be apparent to one skilled in the art.

The actual extent of washing of the polyaniline will also depend on the requirements of the particular application in which the electrorheological fluid will be employed. Applications in which low current flow are important may require the polyaniline to be washed more extensively than applications in which current flow is not critical. The extent of washing of the polymer will correlate to some extent with the conductivity or current density of the electrorheological fluid prepared therefrom. A desired conductivity contribution from the polyaniline can also be obtained by washing the polymer to a low conductivity and redoping to the desired level. For purposes of standardization, the current density of an electrorheological fluid can be measured at 20° C. under a direct current (de) field of 6 kV/mm while undergoing shear of about 500 $sec^{-1}$. The formulation tested will contain 20% by weight of the particulate matter, e.g., polyaniline, to be analyzed in a 10 cSt silicone oil. Preferably the composition will also contain 3 weight % functionalized silicone surfactant such as EXP®69. The measurement will be conducted in a concentric cylinder Couette rheometer modified to apply an electric field across the gap (i.e., between the inner and outer cylinders, which gap can conveniently be 1.25 mm). An electric field is applied and the resultant current density measured. The polyanilines of the present invention, when used as a separate component, will preferably have been washed and optionally redoped so that an electrorheological fluid prepared with the polyaniline alone, tested under the aforementioned conditions, will have a conductivity corresponding to a current density of at most 7000 $mA/m^2$. Preferably the current density will be at most 4000 $mA/m^2$, and increasingly more preferably at most 1000, 750, 200, or even 100 $mA/m^2$. The minimum current density is likewise not precisely limited; current densities of at least 0.01 $mA/m^2$ are preferable, more preferably at least 0.1, 1, or 5 $mA/m^2$.

It has been observed that the electronic conductivity characteristics of the polyaniline salts may be regulated and controlled more precisely by initially removing substantially all of the protons from the polyaniline acid salt obtained from the polymerization reaction, and thereafter treating the deprotonated polyaniline compound with an acid, a halogen, sulfur, sulfur halide, sulfur trioxide, or a hydrocarbyl halide to form a polyaniline compound having a desired conductivity. The level of conductivity obtained can be controlled by the selection of the type and amount of these compounds used to treat the polyaniline which is substantially free of acidic protons. The same procedure can also be used to increase the conductivity of polyaniline acid salts which have not been reacted with a base to the extent necessary to remove substantially all of the acidic protons. This treatment of the polyaniline with an acid, halogen, sulfur, sulfur halide, sulfur trioxide, or hydrocarbyl halide to form a polyaniline compound having a desired conductivity generally is known in the art as "doping".

Any of the acidic compounds described above as being useful reagents in the polymerization of aniline may be utilized as dopants. Thus, the acids may be any of the mineral acids or organic acids described above. In addition, the acid may be the Lewis acid such as aluminum chloride, ferric chloride, stannous chloride, boron trifluoride, zinc chloride, gallium chloride, etc.

The conductivity of polyaniline or certain other polymeric semiconductors can be increased also by treatment with a halogen such as bromine or iodine, or with a hydrocarbyl halide such as methyl iodide, methyl chloride, methyl bromide, ethyl iodide, etc., or with sulfur or a sulfur halide such as sulfur chlorides or sulfur bromides.

The polyaniline or other semiconductive polymers, which are substantially free of acidic protons, can be treated with an amount of the above compounds which is sufficient to provide a desired conductivity as determined by the anticipated utility of the treated polyaniline. The desired conductivity of the treated product will depend in part upon the other components of the electrorheological fluid and the characteristics desired of the ER fluid. The characteristics, including the conductivity and rheological properties of the ER fluid may be varied in part by variations in the conductivity of the organic semiconductor subcomponent, the presence of non-conductive particles in the ER fluid, and the amount of the dispersed particulate phase in the ER fluid. In one embodiment, the polyaniline compounds which have been deprotonated are treated with hydrochloric acid in sufficient quantity to form a product containing up to 5% chloride, more often up to 1%.

The synthesis, washing, doping, and other treatment of polyaniline is described more fully in PCT publication WO93/07244, published Apr. 15, 1993.

Poly(substituted anilines) are also useful. They can be derived from ring-substituted anilines as well as N-substituted anilines. In one embodiment, the poly (substituted anilines) are derived from at least one substituted aniline characterized by the formula

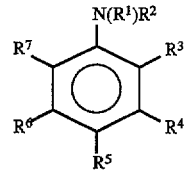

(II)

wherein $R^1$ is hydrogen, a hydrocarbyl group or an acyl group, $R^2$ is hydrogen or a hydrocarbyl group, $R^3$–$R^7$ are each independently hydrogen or an alkyl, halo, CN, OR*, SR*, $NR^*_2$, $NO_2$, COOR*, or $SO_3H$ group, and each R* is independently hydrogen or a hydrocarbyl group, provided that at least one of $R^1$–$R^7$ is not hydrogen and at least one of $R^3$–$R^7$ is hydrogen.

The substituent $R^1$ can be hydrogen, a hydrocarbyl group or an acyl group. The hydrocarbyl group can be an aliphatic or aromatic hydrocarbyl group such as methyl, ethyl, propyl, phenyl, substituted phenyl, etc. The acyl group can be represented by the formula RC(O)— wherein R is an aliphatic or aromatic group, generally aliphatic. Preferred aliphatic groups include methyl and ethyl.

At least one of $R^1$–$R^7$ in the substituted anilines of Formula (II) is a substituent other than hydrogen as defined above. Thus, the substituent can be an alkyl group, particularly a lower alkyl group such as methyl, ethyl, propyl, etc. Alternatively, the group can be a halo group, a cyano group, a hydroxy group, mercapto group, amino group, nitro group, carboxy group, sulfonic acid group, a hydrocarbyloxy group, a hydrocarbylthio group, etc. The hydrocarbyl groups preferably are aliphatic groups, and more preferably lower aliphatic groups containing from 1 to 7 carbon atoms.

In preferred embodiments, at least one of $R^3$ or $R^5$ is hydrogen, and in another embodiment, $R^1$ and $R^2$ also are hydrogen. In another preferred embodiment, $R^1$, $R^4$ or $R^5$ is an alkyl group, an OR* group or COOH group, and the remainder of $R^1$ through $R^7$ are hydrogen. Preferably, the alkyl groups $R^3$, $R^4$ or $R^5$ are methyl groups.

In another embodiment, the substituted aniline can be represented by the formula

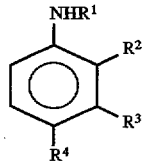

(IIA)

wherein $R^1$ is hydrogen, a hydrocarbyl or an acyl group, $R^2$–$R^4$ are each independently hydrogen, or an alkyl, halo, cyano, OR*, SR*, $NR^*_2$, $NO_2$, COOR*, or $SO_3H$ group, and each R* is independently hydrogen or a hydrocarbyl group provided that at least one of $R^1$–$R^4$ is not hydrogen.

Specific examples of substituted anilines which can be polymerized to poly(substituted anilines) useful in the present invention include o-toluidine, o-ethylaniline, m-toluidine, o-chloroaniline, o-nitroaniline, anthranilic acid, o-cyanoaniline, N-methylaniline, N-ethylaniline, acetanilide, m-acetotoluidine, o-acetotoluidine, p-aminodiphenylamine, benzanilide, 2'-hydroxy-5'-nitroacetanilide, 2-bromo-N-N-dimethylaniline, 4-chloroacetanilide, 4-acetamidothioanisole, 4-acetamido-3-nitrobenzoic acid, 4-amino-3-hydroxybenzoic acid, o-methoxy-aniline, p-methoxyaniline, 2-nitroaniline, 3-nitroaniline, 4-nitroaniline, 2-methoxy-5-nitroaniline, 2-(methylthio)aniline, 3-(methylthio)aniline, 4-(methylthio)aniline, etc.

The polysubstituted anilines are prepared by procedures generally similar to those employed for preparation of polyaniline, above. Polysubstituted anilines and their preparation, as well as certain other polymeric semiconductors (conductive polymers) are described in greater detail in PCT publication WO93/07243, published Apr. 15, 1993.

The present invention is not limited to any particular structural relationship between the polar solid material (i) and the organic semiconductor (ii). Thus these two materials can be present in the electrorheological fluid as substantially separate particles, or they can be present as mixed particles containing both components. In the latter case, the mixed particles can contain the two components combined in any manner, but preferably the organic semiconductor will be at least in part coated on the particles of the polar solid material. This coating can be accomplished by conventional means, such as by application of a solution of the organic semiconductor (particularly when a polymeric material) onto pre-existing particles, followed by drying. Alternatively, a polymeric semiconductor can be polymerized in the presence of particles of the polar, electrorheologically active material. In this case the reaction conditions are believed to affect the extent to which the newly prepared polymer is formed as a coating on the particles, rather than as separate particles. It is believed that polymerization of comparatively dilute solutions of monomer may favor formation of a coating layer. Accordingly, one preferred embodiment provides that aniline monomer is polymerized in the presence of particles of the polar solid materials using a concentration of aniline monomer of at most 0.5 moles/L, preferably at most 0.1 moles/L, more preferably about 0.05 moles/L. This concentration refers to the nominal concentration of aniline employed, without consideration of the instantaneous decrease in concentration due to reaction. Moreover, in general the interaction of polymerization initiators with preexisting particles may lead to chain growth from the surface of the particles, including grafting of the coating polymer to the core particle. It is believed that coating or grafting of the conductive polymer onto the ER active particle is preferred, because such coating is expected to reduce the bulk conductivity of the ER fluid, particularly when the coating material has a lower conductivity than does the core (in the presence of the low molecular weight polar material described below). When this is the case, it is preferred that the amount of the coating polymer be sufficient to cover a substantial portion of the surface area of the core particles.

It is further preferred that the electrorheological fluids of the present invention include a low molecular weight polar material, sometimes referred to as an activator. This low molecular weight polar material is a material other than any of the aforementioned components. It is moreover therefore not a material such as HCl which may be considered a dopant or a material which can interact chemically with the polar solid material or the organic semiconductor to modify its electronic structure or to change its electronic conductivity. The present materials generally interact with the solid material predominantly by hydrogen bonding and are referred to as polar compounds in that they generally have a dielectric constant of greater than 5. They are also commonly relatively low molecular weight materials, having a molecular weight of 450 or less, preferably 225 or less. They are thereby distinguished from other components of the composition of this invention, such as esters which can be used as the hydrophobic liquid medium, which generally have a dielectric constant less than 5 and a molecular weight of greater than 225, preferably greater than 450.

Certain ER-active particles, such as cellulose or polymeric salts, commonly have a certain amount of water associated with them. This water can be considered to be one type of polar activating material. The amount of water present in the compositions of the present invention can be 0.1 to 30 percent by weight, based on the solid particles, although extensive drying can result in lower water contents, and indeed water as such is not believed to be required for the functioning of this invention. The polar activating material can be introduced to the ER fluid as a component of the solid particles (such as absorbed water), or it can be separately added to the fluid upon mixing of the components. Whether the polar activating material remains dispersed through the bulk of the ER fluid or whether it associates with one or both of the components of the particle phase is not precisely known in every case, and such knowledge is not essential to the functioning of the present invention. It has been observed that, when the low molecular weight activating material is employed, the presence of the non-cellulosic polymeric material can, in favorable cases, lead to electrorheological activity which is less dependent on temperature than is the case in the absence of the non-cellulosic polymer.

Suitable polar activating materials can include water, amines, amides, nitriles, alcohols, polyhydroxy compounds, low molecular weight esters, and ketones. Suitable polyhydroxy include ethylene glycol, glycerol, 1,3-propanediol, 1,4-butanediol, 1,5-pentanediol, 2,5-hexanediol, 2-ethoxyethanol, 2-(2-ethoxyethoxy)ethanol, 2-(2-butoxyethoxy)ethanol, 2-(2-methoxyethoxy)ethanol, 2-methoxyethanol, and 2-(2-hexyloxyethoxy)ethanol. Suitable amines include ethanolamine and ethylenediamine. Other suitable materials are carboxylic acids such as formic acid and trichloroacetic acid. Also included are such aprotic polar materials as dimethylformamide, dimethylsulfoxide, propionitrile, nitroethane, ethylene carbonate, propylene carbonate, pentanedione, furfuraldehyde, sulfolane, diethyl phthalate, and the like. Low molecular weight esters include materials such as ethyl acetate; these materials are distinguished from other esters, which are less polar materials with molecular weights commonly greater than 225, which can be used as the inert medium.

While the polar material is believed to be normally physically adsorbed or absorbed by the solid particle phase, it is also possible to chemically react at least a portion of the polar material with one or more of the particle components. This can be done, for example, by condensation of alcohol or amine functionality of certain polar materials with an acid or anhydride functionality on the polar solid material or its precursor. Such reaction is to be distinguished from oxidation/reduction or acid/base reactions which may significantly change the electronic conductivity of the solid;

this reaction with the polar material will generally affect only the ionic conductivity of the substance. Such treatment would normally be effected before any coating material is applied to the particles.

The ER fluid may also contain other typical additives which are commonly employed in such materials, including antioxidants, antiwear agents, and dispersants. Surfactants or dispersants are often desirable to aid in the dispersion of the particles and to minimize or prevent their settling during periods of non-use. Such dispersants are known and can be designed to complement the properties of the hydrophobic fluid. For example, functionalized silicone dispersants or surfactants may be the most suitable for use in a silicone fluid, while hydroxyl-containing hydrocarbon-based dispersants or surfactants may be the most suitable for use in a hydrocarbon fluid. Functionalized silicone dispersants are described in detail in PCT publication WO93/14180, published Jul. 22, 1993, and include e.g. hydroxypropyl silicones, aminopropyl silicones, mercaptopropyl silicones, and silicone quaternary acetates. Other dispersants include acidic dispersants, ethoxylated nonylphenol, sorbitan monooleate, glycerol monooleate, sorbitan sesquioleate, basic dispersants, ethoxylated coco amide, oleic acid, t-dodecyl mercaptan, modified polyester dispersants, ester, amide, or mixed ester-amide dispersants based on polyisobutenyl succinic anhydride, dispersants based on polyisobutyl phenol, ABA type block copolymer nonionic dispersants, acrylic graft copolymers, octylphenoxypolyethoxyethanol, nonylphenoxypolyethoxyethanol, alkyl aryl ethers, alkyl aryl polyethers, amine polyglycol condensates, modified polyethoxy adducts, modified terminated alkyl aryl ethers, modified polyethoxylated straight chain alcohols, terminated ethoxylates of linear primary alcohols, high molecular weight tertiary amines such as 1-hydroxyethyl-2-alkyl imidazolines, oxazolines, perfluoralkyl sulfonates, sorbitan fatty acid esters, polyethylene glycol esters, aliphatic and aromatic phosphate esters, alkyl and aryl sulfonic acids and salts, tertiary amines, and hydrocarbyl-substituted aromatic hydroxy compounds, such as $C_{24-28}$ alkyl phenols, polyisobutenyl ($M_n$ 940) substituted phenols, propylene tetramer substituted phenols, polypropylene ($M_n$ 500) substituted phenols, and formaldehyde-coupled substituted phenols.

The amounts of materials within the present electrorheological fluids are not critical and include all compositions which exhibit electrorheological properties. The specific amounts can be adjusted by the person skilled in the art to obtain the optimum electrorheological properties. The amount of the hydrophobic base fluid is normally the amount required to make up 100% of the composition after the other ingredients are accounted for. Often the amount of the base fluid is 10–94.9 percent of the total composition, preferably 36–89 percent, and most preferably 56–79 percent. These amounts are normally percent by weight, but if an unusually dense dispersed solid phase is used, it may be more appropriate to determine these amounts as percent by volume.

Similarly, the amount of the total particulate phase in the ER fluid should be sufficient to provide a useful electrorheological effect at reasonable applied electric fields. However, the amount of particles should not be so high as to make the fluid too viscous for handling in the absence of an applied field. These limits will vary with the application at hand: an electrorheologically active grease, for instance, would desirably have a higher viscosity in the absence of an electric field than would a fluid designed for use in e.g. a valve or clutch. Furthermore, the amount of particles in the fluid may be limited by the degree of electrical conductivity which can be tolerated by a particular device, since the particles normally impart at least a slight degree of conductivity to the total composition. For most practical applications the particles will comprise 1 to 80 percent by weight of the ER fluid, preferably 5 to 60 percent by weight, more preferably 10 to 50 percent by weight, and most preferably 15 to 35 percent by weight. Of course if the nonconductive hydrophobic fluid is a particularly dense material such as carbon tetrachloride or certain chlorofluorocarbons, these weight percentages could be adjusted to take into account the density. Determination of such an adjustment would be within the abilities of one skilled in the art.

The components within the particle phase, that is (i), the polar solid material, and (ii), the organic semiconductor, are present in relative amounts of at least (i):(ii)=2:1 by weight. Preferably the relative amounts are 3:1 to 40:1, and more preferably 5:1 to 20:1. More generally, the amount of the organic semiconductor (ii) should be an amount which leads to acceptable ER performance, and preferably improved performance compared with the same material in the absence of this component. In particular, it is especially desirable to use an amount sufficient to lead to increased ER activity and or reduced power consumption (power density) of the fluid. ER activity can be measured simply in terms of increase in shear strength, as defined by the test reported above. A more complete evaluation can be made by considering the steady-state Winslow number, Wn. This number is measured at a constant field after the fluid has reached a (constant) maximum strength, and can be measured in an oscillating duct flow apparatus described above:

$$Wn = \frac{(YS)^2}{(PD)(\eta_0)}$$

$YS$ = Yield stress ($Pa$) under field $PD$ = Power density ($w/m^3$)
= Current density × Field strength $\eta_0$ = Viscosity with no field applied ($PaS$)

Alternatively, for some applications the "millisecond Winslow number," Wn' is more useful:

$$Wn' = \frac{(\Delta SS)^2}{(PD)(\eta_0)}$$

where PD and $\eta_0$ are defined as above and ASS is the shear stress increase at 5 ms when field is applied. This measurement is made using a 5 Hz oscillation (about 6000 $s^{-1}$); the shear stress 5 milliseconds after application of a field (normally 6 kV/mm) is measured, and the shear stress in the absence of field is subtracted therefrom. A higher value for Wn or Wn' indicates better ER performance overall.

The amounts of the low molecular weight polar material activating material is preferably 0.5 to 10 percent by weight, based on the entire fluid composition, preferably 2 to 5 weight percent, based on the fluid The amount of the optional surfactant or dispersant component in the present invention is an amount sufficient to improve the dispersive stability of the composition. Normally the effective amount will be 0.1 to 20 percent by weight of the fluid, preferably 0.4 to 10 percent by weight of the fluid, and most preferably 1 to 5 percent by weight of the fluid.

The ER fluids of the present invention find use in clutches, valves, dampers, torque transfer devices, positioning equipment, and the like, where it is desirable to vary the apparent viscosity of the fluid in response to an external signal. Such devices can be used, for example, to provide an automotive shock absorber which can be rapidly adjusted to meet the road conditions encountered during driving.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Such groups include hydrocarbon groups, substituted hydrocarbon groups, and hetero groups, that is, groups which, while primarily hydrocarbon in character, contain atoms other than carbon present in a chain or ring otherwise composed of carbon atoms.

EXAMPLES

Example 1

Four hundred fifteen grams of concentrated hydrochloric acid is diluted with 3 L distilled water in a 12 L round bottom flask. Aniline, 465 g, is added dropwise. The mixture is cooled to 5° C. in an ice bath. A solution of ammonium persulfate, 1140 g in 3.5 L of distilled water, is added dropwise over 8 hours. The reaction mixture is left stirring overnight.

The reaction mixture is filtered and the solids are collected. The solids are returned to the flask along with 6 L of water, and are stirred for 24 hours.

The mixture is again filtered and the solids are collected and placed in the flask along with 330 mL concentrated ammonium hydroxide and 6 L distilled water. The mixture is stirred for 24 hours.

The mixture is filtered and the recovered solid is again placed into a flask with 330 mL concentrated ammonium hydroxide and 6 L water. The mixture is stirred for 48 hours.

The mixture is filtered and the recovered solids are stirred with 6 L distilled water for 24 hours. The mixture is thereafter filtered and the solid flushed with 4 L of distilled water.

The recovered solid is predried while still in the filter funnel for 18 hours at 20° C. Thereafter the solid is sieved through a 710 mm screen, dried at 150° C. under vacuum for 17 hours, and then placed in a glass jar.

Example 2

Hydrochloric acid (166 mL, 2 moles) is diluted to two liters with distilled water in a five-liter flask, and 186 parts (2 moles) of aniline are added dropwise. In a separate vessel, 456 parts (2 moles) of ammonium persulfate are dissolved in 1400 mL. of water, and this solution is then added dropwise to the five-liter flask containing the aniline and hydrochloric acid while maintaining the temperature of the contents of the flask at between about 5 to 10° C. over a period of 5.5 hours with stirring. The mixture then is stirred for about 24 hours at room temperature. The contents of the reaction flask are filtered, and the residue is slurried with two liters of distilled water for one day and then filtered. The residue is slurried in two liters of methanol for one day and filtered. The polyaniline acid salt is obtained by drying the filtrate in air at 60° C. followed by drying under dynamic vacuum at 150° C. The aniline salt obtained in this manner contained 3.11% chlorine, 11.89% nitrogen, 4.70% sulfur.

The above prepared hydrochloric acid salt is deprotonated in the following manner. Concentrated aqueous ammonium hydroxide (99 parts, 1.5 moles) is diluted to 3000 parts with distilled water in a five-liter flask, and 150 parts of the polyaniline hydrochloride salt are added slowly with stirring. When all of the salt has been added, the mixture is stirred for one day. The contents of the flask are filtered, and the filtrate is slurried with two liters of distilled water for one day. The desired product is recovered by filtration and is dried initially in air at 60° C., screened and thereafter dried under dynamic vacuum at 150° C.

Examples 3–14

Electrorheological fluid compositions are prepared by admixing the polyaniline of Example 1, in the amount indicated, with the amounts of the other materials indicated in the following table. The admixing is accomplished using a ball mill.

| Example | Polyaniline % | Cellulose % | Ethylene Glycol, % | Surfactant % | Medium, % |
|---|---|---|---|---|---|
| 3 | 3 | 27 | 3.5 | 3 | S, 63.5 |
| 4 | 3 | 27 | 2.5 | 3 | S, 64.5 |
| 5 | 5 | 25 | 3.5 | 3 | S, 63.5 |
| 6 | 5 | 25 | 3 | 0 | S, 67 |
| 7 | 5 | 25 | 3 | 3 | E, 64 |
| 8 | 5 | 25 | 2.5 | 3 | S, 64.5 |
| 9 | 4 | 25 | 4 | 3 | S, 64 |
| 10 | 7.5 | 22.5 | 3.5 | 3 | S, 63.5 |
| 11 | 7.5 | 22.5 | 3 | 3 | S, 64 |
| 12 | 7.5 | 22.5 | 2.5 | 3 | S, 64.5 |
| 13 | 4 | 21 | 2.5 | 3 | S, 69.5 |
| 14 | 4 | 21 | 1.5 | 3 | S, 70.5 |

Notes: The cellulose is CC31 from Whatman except in Ex. 9, where FMC ™ NT013 microcrystalline cellulose is used. The surfactant is EXP 69 ™ functionalized silicone, except in Example 7, where it is a $C_{24-28}$ alkyl substituted phenol. The medium is 5 cSt silicone oil, except for Example 7, where it is Emery ™ 2911 (isodecyl pelargonate).

Each of Examples 3–14 is tested to demonstrate electrorheological properties.

Example 15

Example 7 is repeated except that the cellulose is replaced by silica gel.

Example 16

Example 7 is repeated except that the polyaniline is replaced by each of the following materials, in turn:

(a) poly(o-toluidine), prepared according to Example 1 of PCT publication WO93/07243, published Apr. 15, 1993.

(b) poly(o-chloroaniline), prepared according to Example 6 of WO93/07243.

(c) poly(N-methylaniline), prepared according to Example 7 of WO93/07243.

(d) poly(pyrrole), prepared according to Example 10 of WO93/07243.

Example 17

A 12 L, 4-necked round bottom flask, equipped with a mechanical stirrer, thermometer, condenser, and addition inlet is secured in a water bath. To the flask is added 6000 g of water, 40 g HCl (0.44 moles), 200 g cellulose, and 40 g aniline (0.43 moles). The effective concentration of aniline is 0.05M. The contents of the flask are stirred and the temperature is maintained at or below 25° C.

Separately, a solution is prepared of ammonium persulfate (100 g, 0.43 moles) in distilled water (1 part by weight ammonium persulfate per 2.5 parts water). The ammonium persulfate solution is added to the above flask at a rate of 2.0 mL/minute, while maintaining the temperature of the reaction mixture at or below 25° C. After addition is complete, the reaction mixture is allowed to stir for an additional 16 hours.

The reaction mixture is filtered to obtain a blue-black solid. The solid is returned to the 12 L flask, and 6 L distilled water is added. The mixture is stirred at medium speed. Aqueous $NH_4OH$ (28 g, 0.43 moles) is added to the mixture; the mixture is stirred at medium speed for 20 hours.

The washed solids are again isolated by filtration and returned to the flask. Distilled water, 6L, is added and the mixture stirred for an additional 6 hours, then isolated by filtration.

The black solid isolated is dried in a forced-air oven at 105° C. for 20 hours, then sieved through a 710 μm mesh, and finally dried at 150° C. under dynamic vacuum for 17 hours.

Example 18

The apparatus of Example 17 is employed. Into the flask is placed 6000 g distilled water, 40 g HCl, 200 g cellulose, and 100 g ammonium persulfate). The mixture is stirred on a fast setting and maintained at 25° C. or below. To this mixture is added aniline (40 g) at a rate of 0.5 mL/minute, while maintaining the temperature as indicated. After the addition is complete, the mixture is stirred for an additional 16 hours. The product is isolated by filtration, washed, and dried as in Example 17.

Example 19

The dried solids from Example 17 (37.5 g) are placed in a ball mill jar (previously dried at 105° C. under vacuum). Thereafter are added EXP 69™ surfactant (1.25 g), ethylene glycol (3.75 g, via a syringe), and silicone oil, 5 cSt (82.5g). Seven balls are added to the jar as grinding media. The jar is closed and rolled for 24 hours. Thereafter the contents of the jar are tested and found to exhibit electrorheological activity.

Example 20

Example 19 is repeated using the dried solids from Example 18.

Example 21

Example 19 is substantially repeated, except the ethylene glycol is replaced by propylene glycol.

Example 22

Example 19 is substantially repeated except that the silicone oil is replaced by Emery™ 291 l(isodecyl pelargonate) (81.25 g) and the EXP 69™ surfactant is replaced by $C_{24-28}$ alkyl substituted phenol (2.5 g).

Example 23

The apparatus of Example 17 is employed. Into the flask is placed 6000 g distilled water, ferric chloride (373 g), and 200 g cellulose,). The mixture is stirred on a fast setting and maintained at 25° C. or below. To this mixture is added pyrrole (67.09 g, 1 mole) dropwise over a period of about 45 minutes, while maintaining the temperature as indicated. After the addition is complete, the mixture is stirred overnight at room temperature, filtered, and the residue washed with distilled water until the filtrate is colorless. The residue is dried overnight in air at 60° C. and dried under dynamic vacuum at 120–125° C.

The same flask is charged with 66 g of aqueous ammonium hydroxide and 3 L of distilled water. The solid particulate product is added and the mixture is stirred at room temperature for one day. The mixture is filtered, and the residue is slurried with 3 L distilled water overnight. The slurry is filtered, and the residue is dried under dynamic vacuum at 150° C.

The powder obtained is compounded into an electrorheological fluid.

Example 24

Cellulose is coated with a polyaniline dispersion available from Allied signal under the tradename Versicon Coatings™. Two samples are obtained, each containing 60 weight % volatile materials and 40 weight % solids. Of the solid component, 3–5% is polyaniline; the remainder is believed to be an inert resin such as polyethylene. The two samples are said to exhibit different surface resistivity (a) $10^3$–$10^4$ ohms/square or (b) 50–250 ohms/square (neat solution). To prepare the compositions, cellulose (50 g), Versicon™ dispersion, (each sample, in separate experiments) (27.0 g) and xylene (300 g) are vigorously mixed in a 1 L round bottom flask. The solvents are removed by rotary evaporation and the resulting solids are dried in a forced air oven at 70° C. for 24 hours. The resulting solid is washed for 3.5 hours in a mixture of water (1000 mL) and concentrated $NH_4OH$ (25 mL). The solid is isolated by filtration and further slurried with 1000 mL water, isolated, and dried in a forced air oven at 70° C. for 24 hours, sieved through a 710 μm mesh, and dried under dynamic vacuum at 150° C. for 24 hours.

An electrorheological fluid is prepared from each such solid composition by combining, as in Example 19, 30.0 g of the solids, 2.0 g ethylene glycol, 2.0 g EXP-69™ surfactant, and 66.0 g 5 cSt silicone oil. The fluids are tested for electrorheological activity.

Examples 25–48

A series of experiments are run in which the weight ratio of cellulose:aniline, the order of addition of reactants, and the concentration of the aniline, in syntheses similar to those of Examples 17 and 18, are varied. Thereafter the concentrations of EXP™69 and ethylene glycol are varied. The levels of these variable are shown in the following table:

| Variable: levels | – | 0 | + |
|---|---|---|---|
| Cellulose:aniline ratio (wt.) | 3:1 | 5:1 | 8:1 |
| Addition order: as in Ex: | 17 | | 18 |
| Concentration of aniline (M) | 0.05 | | 0.10 |
| wt. % of EXP ™69 | 1.0 | | 3.0 |
| wt. % of ethylene glycol | 1.5 | | 3.0 |

The following compositions are prepared, tested, and shown to exhibit electrorheological activity:

| Ex. | Cell:ani | Order | [aniline] | % EXP 69 | % $Et(OH)_2$ |
|---|---|---|---|---|---|
| 25 | – | – | – | + | + |
| 26 | – | – | – | – | – |
| 27 | – | – | – | – | + |

-continued

| Ex. | Cell:ani | Order | [aniline] | % EXP 69 | % Et(OH)$_2$ |
|---|---|---|---|---|---|
| 28 | − | − | + | − | + |
| 29 | − | − | + | + | − |
| 30 | − | + | + | − | + |
| 31 | − | + | + | + | − |
| 32 | − | + | − | + | + |
| 33 | − | + | − | − | − |
| 34 | − | + | − | − | + |
| 35 | + | − | + | + | + |
| 36 | + | − | + | − | − |
| 37 | + | − | + | − | + |
| 38 | + | − | − | − | + |
| 39 | + | − | − | + | − |
| 40 | + | + | − | − | + |
| 41 | + | + | − | + | − |
| 42 | + | + | + | + | + |
| 43 | + | + | + | − | − |
| 44 | + | + | + | − | + |
| 45 | 0 | − | + | − | + |
| 46 | 0 | − | − | − | + |
| 47 | 0 | + | − | − | + |
| 48 | 0 | + | + | − | + |

Example 49

Example 37 is substantially repeated except that the amount of ethylene glycol in the formulated fluid is 4.0% by weight.

Example 50

Example 37 is substantially repeated except that the cellulose is FMC™ NT013 microcrystalline cellulose.

Example 51

A 3 L resin flask is charged with 750 mL water and 134.7 g concentrated aqueous HCl. The mixture is stirred while slowly adding 104.6 g aniline and 24.9 g phenothiazine. Toluene, 150 mL, isopropanol, 200 mL, and alcohol, 5 mL, are added to insure solution of the monomers. To an addition funnel is charged a solution of 312.4 g ammonium persulfate in 875 mL water. The flask is cooled to 6° C. and the ammonium persulfate solution is added dropwise at 3–6° C. over 3 hours. Stirring is continued for 16 hours, then for 24 hours at room temperature.

The resulting solids are isolated by filtration, washed by stirring in 3 L water for several hours, filtered, slurried in 3 L toluene for several hours (repeated), extracted with toluene in a Soxhlet extractor until no color is extracted from the solids, then dried in a steam chest. The resulting solids are further slurried with 3.5 L water, to which is thereafter added 100 mL concentrated $NH_4OH$, and the mixture slurried for several days. The isolated solids are thereafter slurried twice slurried in water for a period of days, until the pH of the filtrate is neutral. The solids are dried in an steam chest, passed through a 710 μm sieve, then vacuum dried for 10 hours at 120° C.

Example 52

Into a 3 L round bottomed flask is placed 84 mL concentrated HCl and 600 mL water; aniline (85.7 g) and N-methylpyrrole (8.1 g) are added slowly. The mixture is cooled to 5° C., and a solution of 296.4 g ammonium persulfate in 700 mL water is added dropwise over 2.5 hours. The slurry is stirred overnight, then filtered, and the solids are slurried in 2 L of water overnight. The solids are thereafter slurried with 1500 mL water and 100 mL concentrated $NH_4OH$, isolated by filtration, and washed with water. The solids are isolated and dried in a vacuum oven at 130° C.

Example 53

A 5 L flask is charged with 167.4 g aniline, 36.85 g N-phenyl-p-phenylenediamine, 166 mL concentrated HCl, and 1200 mL water. The mixture is cooled to 4° C., and a solution of 456 g ammonium persulfate in 1400 mL water is added, with stirring, over 7 hours. The mixture is stirred overnight and the solids isolated by filtration. The solids are washed by slurrying overnight with, in turn, 3 L distilled water, 3 L methanol, 2.5 L distilled water with 132 mL NH4OH (two times for 48 hours), and 2.5 L distilled water. The solid are isolated by filtration, dried in a steam oven, ground with mortar and pestle, sieved through a 710 μm mesh, and dried in a vacuum oven at 150° C.

Example 54

Example 53 is repeated using, in place of the N-phenyl-p-phenylenediamine, an equivalent amount of 2,2'-dimethyl-N-phenyl-p-phenylenediamine.

Example 55

Example 7 is repeated replacing the polyaniline with each of the materials of Examples 51–54 in turn. The samples thus prepared are tested for electrorheological properties.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which can contain the isomers, by-products, derivatives, and other such materials which are normally understood to be present in the commercial grade. However, the amount of each chemical component is presented exclusive of any solvent or diluent oil which may be customarily present in the commercial material, unless otherwise indicated. As used herein, the expression "consisting essentially of" permits the inclusion of substances which do not materially affect the basic and novel characteristics of the composition under consideration.

What is claimed is:

1. An electrorheological fluid of a particulate phase and a continuous phase, comprising:

(a) a hydrophobic liquid medium, (b) a dispersed particulate phase comprising (i) a polar solid material which is capable of exhibiting substantial electrorheological activity only in the presence of a low molecular weight polar material, wherein the polar solid material is a cellulosic material and (ii) an organic semiconductor which exhibits a conductivity of about $10^3$ to about $10^{-12}$ siemens/cm, wherein the organic semiconductor is a polyaniline, and wherein the weight ratio of the polar solid material to the organic semiconductor is at least about 2:1, wherein the organic semiconductor and the polar solid material are present as mixed particles containing both components, and wherein the organic semiconductor is at least in part coated on particles of polar solid material; and (c) a low molecular weight polar material.

2. The electrorheological fluid of claim 1 wherein the cellulosic material is cellulose.

3. The electrorheological fluid of claim 1 wherein the polyaniline is polyaniline homopolymer.

4. The electrorheological fluid of claim 1 wherein the polyaniline is a polyaniline copolymer.

5. The electrorheological fluid of claim 1 wherein the polyaniline is a polymer comprising at least one substituted aniline monomer.

6. The electrorheological fluid of claim 4 wherein the polyaniline is a copolymer of aniline and at least one comonomer selected from the group consisting of substituted anilines, pyrroles, vinylpyridines, vinylpyrrolidones, thiophenes, vinylidene halides, phenothiazines, imidazolines, N-phenyl-p-phenylene diamines, and mixtures thereof.

7. The electrorheological fluid of claim 1 wherein the weight ratio of the polar solid material to the organic semiconductor is about 3:1 to about 40:1.

8. The electrorheological fluid of claim 1 wherein the weight ratio of the polar solid material to the organic semiconductor is about 5:1 to about 20:1.

9. The electrorheological fluid of claim 1 wherein the polyaniline is prepared by polymerization of aniline in the presence of particles of the polar solid material.

10. The electrorheological fluid of claim 9 wherein the aniline is polymerized using a concentration of aniline monomer of at most about 0.5 mole/liter.

11. The electrorheological fluid of claim 1 further comprising a surfactant.

12. The electrorheological fluid of claim 1 wherein the amount of the dispersed particulate phase is about 1 to about 80 percent by weight.

13. The electrorheological fluid of claim 1 wherein the amount of the dispersed particulate phase is about 5 to about 50 percent by weight.

14. The electrorheological fluid of claim 1 wherein the amount of the dispersed particulate phase is about 15 to about 35 percent by weight.

15. The electrorheological fluid of claim 1 wherein the low molecular weight polar material is selected from the group consisting of water, amines, amides, nitriles, alcohols, polyhydroxy compounds, low molecular weight esters, and ketones.

16. The electrorheological fluid of claim 1 wherein the low molecular weight polar material is an organic compound.

17. The electrorheological fluid of claim 16 wherein the organic compound is a polyol.

18. The electrorheological fluid of claim 1 wherein the polyol is ethylene glycol.

19. The electrorheological fluid of claim 1 wherein the amount of the low molecular weight polar material is about 0.5 to about 10 percent by weight of the fluid.

20. The electrorheological fluid of claim 1 wherein the amount of the low molecular weight polar material is about 2 to about 5 percent by weight of the fluid.

21. The electrorheological fluid of claim 1 wherein the hydrophobic liquid medium is silicone oil.

22. The electrorheological fluid of claim 1 wherein the hydrophobic liquid medium is a hydrocarbon oil.

23. The electrorheological fluid of claim 1 wherein the hydrophobic liquid medium is an ester.

24. The electrorheological fluid of claim 1 wherein the weight ratio of the cellulosic material to the polyaniline is at least about 5:1.

25. A clutch, valve, shock absorber, damper, or torque transfer device containing the fluid of claim 1.

26. A method for increasing the apparent viscosity of a fluid of a particulate phase and a continuous phase, said fluid comprising:

(a) a hydrophobic liquid phase;

(b) a dispersed particulate phase comprising (i) a polar solid material which is capable of exhibiting substantial electrorheological activity only in the presence of a low molecular weight polar material, wherein the polar solid material is a cellulosic material; and (ii) an organic semiconductor exhibiting a conductivity of about $10^3$ to about $10^{-12}$ siemens/cm, wherein the organic semiconductor is a polyaniline, and wherein the weight ratio of the polar solid material to the organic semiconductor is at least about 2:1, wherein the organic semiconductor and the polar solid material are present as mixed particles containing both components, and wherein the organic semiconductor is at least in part coated on particles of polar solid material; and (c) a low molecular weight polar material;

said method comprising applying an electric field to said fluid.

* * * * *